US009147568B2

(12) United States Patent
Blenkinsopp et al.

(10) Patent No.: US 9,147,568 B2
(45) Date of Patent: Sep. 29, 2015

(54) WATER CLUSTER ION BEAM MASS SPECTROMETER APPARATUS AND METHOD

(71) Applicant: Ionoptika Limited, Hampshire (GB)

(72) Inventors: Paul William Miles Blenkinsopp, Hampshire (GB); Andrew Mark Barber, Hampshire (GB)

(73) Assignee: Ionoptika Limited, Hampshire (GB)

( * ) Notice: Subject to any disclaimer, the term of this patent is extended or adjusted under 35 U.S.C. 154(b) by 0 days.

(21) Appl. No.: 14/265,766

(22) Filed: Apr. 30, 2014

(65) Prior Publication Data

US 2014/0319333 A1 Oct. 30, 2014

(30) Foreign Application Priority Data

Apr. 30, 2013 (GB) ..... 1307792.0

(51) Int. Cl.

| | |
|---|---|
| ***H01J 49/26*** | (2006.01) |
| ***H01J 49/02*** | (2006.01) |
| ***H01J 49/14*** | (2006.01) |
| ***H01J 27/02*** | (2006.01) |
| ***H01J 49/00*** | (2006.01) |

(52) U.S. Cl.

CPC ..... *H01J 49/142* (2013.01); *H01J 27/026* (2013.01); *H01J 49/0031* (2013.01)

(58) Field of Classification Search

CPC ..... H01J 49/0031; H01J 49/142; H01J 49/10; H01J 27/026; H01J 27/02; G01N 27/62; G01N 23/2258

USPC ..... 250/281, 282, 285, 286, 288, 423 R, 250/424, 492.3, 283, 306, 307, 309, 250/492.21; 204/192.34, 298.36; 438/515

See application file for complete search history.

(56) References Cited

U.S. PATENT DOCUMENTS

| | | | | |
|---|---|---|---|---|
| 4,559,096 | A * | 12/1985 | Friedman et al. | 156/272.2 |
| 4,755,344 | A * | 7/1988 | Friedman et al. | 376/108 |
| 5,173,610 | A * | 12/1992 | Lo | 250/424 |
| 5,582,879 | A * | 12/1996 | Fujimura et al. | 427/561 |
| 6,989,528 | B2 * | 1/2006 | Schultz et al. | 250/281 |
| 7,247,845 | B1 * | 7/2007 | Gebhardt et al. | 250/281 |
| 7,429,729 | B2 * | 9/2008 | Schultz et al. | 250/287 |
| 7,547,878 | B2 * | 6/2009 | Schultz et al. | 250/282 |

(Continued)

FOREIGN PATENT DOCUMENTS

| | | | |
|---|---|---|---|
| JP | 2011029043 | A | 10/2011 |
| WO | 2005094389 | A2 | 10/2005 |
| WO | 2007125726 | A1 | 8/2007 |

OTHER PUBLICATIONS

Intellectual Property Office, Search Report, Oct. 30, 2013, 6 pages, Concept House, South Wales, United Kingdom.

*Primary Examiner* — David A Vanore

(74) *Attorney, Agent, or Firm* — Stephen F. Rost; Taft Stettinius & Hollister LLP

(57) ABSTRACT

A mass spectrometer for producing a primary beam of ions for bombarding a sample under vacuum. The mass spectrometer includes a detector for detecting a secondary beam of ions released from the sample. The primary beam of ions includes water clusters where each water cluster contains between 1 and 10,000 water molecules. The primary beam of ions, in one embodiment, is produced by adiabatic expansion of water vapor. An auxiliary beam of ions for bombarding the sample includes a different species to those of the primary beam of ions.

30 Claims, 4 Drawing Sheets

(56) References Cited

U.S. PATENT DOCUMENTS

| | | | | |
|---|---|---|---|---|
| 7,915,579 | B2 * | 3/2011 | Chen et al. | 250/288 |
| 8,890,059 | B2 * | 11/2014 | Johnson et al. | 250/282 |
| 8,963,081 | B2 * | 2/2015 | Iwasaki | 250/288 |
| 2006/0208741 | A1 * | 9/2006 | Hiraoka | 324/459 |
| 2007/0227879 | A1 * | 10/2007 | Imamura et al. | 204/192.34 |
| 2010/0059674 | A1 | 3/2010 | Chen et al. | |
| 2010/0127163 | A1 * | 5/2010 | Zhdaneev et al. | 250/282 |
| 2012/0037799 | A1 * | 2/2012 | Sakairi | 250/288 |
| 2013/0285552 | A1 * | 10/2013 | Duerr et al. | 315/111.91 |
| 2014/0319332 | A1 * | 10/2014 | Blaschke | 250/282 |
| 2014/0319333 | A1 * | 10/2014 | Blenkinsopp et al. | 250/282 |
| 2014/0374585 | A1 * | 12/2014 | Murayama et al. | 250/282 |
| 2014/0374586 | A1 * | 12/2014 | Murayama et al. | 250/282 |
| 2014/0374587 | A1 * | 12/2014 | Murayama et al. | 250/282 |

* cited by examiner

WATER CLUSTER ION BEAM MASS SPECTROMETER APPARATUS AND METHOD

RELATED APPLICATIONS

This application claims priority to and the benefit of GB Application No. 1307792.0, filed on Apr. 30, 2013, which is hereby expressly incorporated by reference in its entirety.

FIELD OF THE DISCLOSURE

The present disclosure relates to an improved mass spectrometer and an analytical method associated therewith.

BACKGROUND

In 1910, the British physicist J. J. Thomson observed that positive ions and neutral atoms were released from a solid surface when bombarded with ions. Later, in 1949, improvements in vacuum pumps and associated technologies enabled the first prototype experiments on Secondary Ion Mass Spectrometry (SIMS) to be carried out by Herzog and Viehbock at the University of Vienna in Austria. Since the earliest days, the potential for SIMS to be a very powerful analytical technique has been recognised but has not yet realised its fullest potential. In the intervening years to now, the SIMS technique has expanded to encompass many different and useful methods of material analysis, many of which are not achievable by other analytical methods. These include 2 dimensional chemical mapping or imaging, depth profiling and more recently the capability to obtain detailed chemical and compositional information from biological and bio-chemical materials. The range of probes of the material has also increased, starting from elementary ion probes, such as argon or oxygen, but now including large molecular clusters such as C60, giant gas clusters and laser ablation. Other improvements to the SIMS technique have included improved mass and spatial resolution, the possibility to measure non-ionised material removed from the sample by post ionisation, the so called Secondary Neutral Mass Spectrometry (SNMS) that permits analysis of the removed material in a mass spectrometer and the ubiquitous advances in computing technology that has led to a vast array of instrument control, data capture and analysis facilities.

Several methods of analysis in a mass spectrometer are used for SIMS. These include mass separation by using powerful electromagnets, the so called Magnetic Sector instrument, mass separation by the application of Radio Frequency (RF) electric fields, the so called Quadrupole and the Ion Trap, and the separation of masses by their arrival time at a detector, the technique known as Tine of Flight (ToF). The Time of Flight SIMS technique is particularly well suited to analysis of organic samples, because it can simultaneously detect ions from a wide mass range, allowing for a very high efficiency in detecting a large proportion of secondary ions. FIG. 1 shows a typical arrangement inside the vacuum chamber of a ToF-SIMS instrument. The sample to be analysed is mounted on a holder (1) which is introduced into a vacuum chamber (2) and secured on a motion stage (3). A primary ion beam (4) is generated by an ion source (not shown), accelerated and directed at the sample. The vacuum housing (5) that encloses the ion source is shown in part. The impact of primary ions on the sample surface causes secondary ions to be ejected from the sample and these are captured and accelerated by the extraction optics (6). These ions travel in the direction (7) to enter a time of flight analyser (not shown) and ultimately to hit an ion detector. The vacuum housing (8) for the analyser is shown in part. The time of flight analyser can be simply a flight tube, but may also contain other ion-optical components such as energy-compensating devices, focusing or alignment devices or pulsing devices.

During the latter part of the twentieth century SIMS developed largely as a technique for elemental analysis. Atomic or small molecular ion beams, made of species such as $Ga^+$, $Cs^+$, $O_2^+$, $Ar^+$, were used as primary ion beams to stimulate emission of secondary ions. Such primary beams cause too much damage at the sample surface and too much fragmentation of emitted material to produce large molecular secondary ions. So, the technique was limited to elemental analysis or, at best detection of small molecular fragments. Ion beams of different species offered a range of features, suiting them to different variants of SIMS analysis. For example, a small probe size is advantageous for high spatial resolution imaging or a good beam shape is advantageous for depth profiling. Oxygen beams enhance yields of positive secondary ions, whilst caesium beams enhance negative secondary ion yields.

Around the year 2000, cluster ion beams were introduced to extend the mass range of the SIMS technique and to enable organic analysis. The earliest cluster ion primary beams were small metallic clusters produced by a liquid metal ion source (LMIS), for instance gold clusters of 2 or 3 gold atoms (N. Davies, D. E. Weibel; N P. Lockyer, P. Blenkinsopp, R. Hill, J C. Vickerman *Appl. Surf. Sci.* 203-204 (2003) 223-227), followed by similar sources using alternative metals such as bismuth. Such beams were able to release secondary ions of whole organic molecules and large fragments, but they cause too much damage to underlying sample to continue analysis beyond the top monolayer or so of the sample surface, when used by themselves. The first cluster beam that was routinely capable of analysing a polymer or organic sample whilst etching through its bulk was the $C_{60}$ ion beam (D. Weibel, S. Wong, N. Lockyer, P. Blenkinsopp, R. Hill, J C. Vickerman, *Anal. Chem.* 75 (2003) 1754). $C_{60}$ was found to produce higher yields of organic molecules with much reduced damage to the underlying sample. This is because, with 60 atoms in its cluster, the beam energy is dissipated only in the top few layers of the sample, releasing intact secondary ions by shaking them from the surface surrounding each impact site and leaving underlying chemistry largely undamaged.

The next significant development in ion beams for organic SIMS was the Gas Cluster Ion Beam (GCIB). Cluster formation through a supersonic expansion was first studied by Becker et al. for thermonuclear fuel applications (E. W. Becker, K. Bier, W. Henkes, *Z. Phys.* 146 (1956) 6511). Clusters are typically formed by creating an adiabatic expansion of a gas from a high pressure region into a low pressure region through a small orifice. As the gas expands, it cools, and clusters are formed. These clusters can range from 2 atoms up to tens of thousands of atoms. By ionising the clusters, it is possible to produce charged clusters, which can then be mass filtered if required, and accelerated to produce an ion beam that can be directed onto a sample. Cluster beams can deliver a large amount of the cluster material to the sample at relatively low energies per atom within the cluster. This has opened out new applications using them for cleaning surfaces, reducing surface roughness, and depositing material on the surface.

Over the past decade, there has been much work done with argon gas cluster ion beams for use in modifying surface properties of materials (Isao Yamada, Jiro Matsuo, Noriaki Toyoda, Norihisa Hagiwara, *Nucl. Instr. and Meth. B* 161-163 (2000) 980-985). More recently, argon gas cluster ion beams have been used for sputtering material in SIMS, where they have been shown to be able to sputter large organic molecules with less fragmentation and damage then occurs when atomic ion beams are used (Sadia Rabbani, Andrew M. Barber, John S. Fletcher, Nicholas P. Lockyer, and John C. Vickerman, *Anal. Chem.* 2011, 83, 3793-3800).

In present day organic SIMS analysis, the $C_{60}$ and argon cluster beams are used as low-damage beams either for etching away layers of sample between analyses by another ion beam, or for direct SIMS analysis. The use of these cluster beams has opened out the use of SIMS in analysis of polymers and biological material. However, there is a remaining problem of sensitivity to large molecular species which may be present in very small concentrations in the sample. This problem arises from the need to detect such large molecules from within a very small area of the sample. One of the most promising fields for organic SIMS is in the imaging of cells, tissue, or other structures with very fine features. The imaging technique usually proceeds by scanning the primary ion beam across the sample in steps, thus acquiring a mass spectrum from a series of pixels. With a suitable scan pattern, a complete image of a sample area is built up, with a mass spectrum for each pixel in the image. With present day ion beams ($C_{60}$ and argon clusters) detection of important organic molecules, such as lipids or peptides, becomes unsatisfactory when the pixel size decreases below a few square microns. The number of molecules available for interrogation within such a small area is limited and the technique may need to be sensitive to less than an attomole presence of a particular molecule in each pixel. ToF SIMS instrumentation has been improved to give high transmission and dynamic range in order to maximise sensitivity; there remains little room for improvement through instrument development. However, there is an opportunity to achieve significantly higher sensitivity by increasing the yield of secondary ions. Most of the material that is sputtered from the surface leaves as neutral molecules or fragments. By causing the ionisation of more of this material, sensitivity in organic analysis would be increased proportionately.

We have invented a water cluster primary ion beam that provides a surprisingly good enhancement in ion yields. Water clusters formed by adiabatic gas expansion have been previously studied for their effects on smoothing and oxidation of surfaces (Hiromichi Ryuto, Keiji Tada, Gikan, H. Takaoka, *Vacuum Vol.* 84, Issue 5, 10 Dec. 2009, Pages 501-504), and methods for generating such clusters have been described. Droplets of protonated water (ie. $H(H_2O)_n^+$) produced by squirting a liquid mixture of water, methanol and acetic acid through a fine capillary have been found to give a small increase in ionisation when sprayed at low energy onto a surface during SIMS analysis (Guangtao Li, Jobin Cyriac, Liang Gao and R. Graham Cooks, *Surface and Interface Analysis* Vol. 43, Issue 1-2, 498-501, January-February 2011) compared to the significant increase in ion yield that can be achieved with the present disclosure. This experiment used a wide spray of protonated droplets rather than a focussed beam of water clusters. In our disclosure, the beam can be focused to less than 5 microns, allowing the use of the beam for analysis at high spatial resolution or for precise co-targeting of an analysis point with another beam performing analysis. Organic samples are often frozen for SIMS analysis in order to preserve the hydrated structures of the samples, for instance in analysis of cells or tissues, or to stabilise chemistry under ion bombardment, as in some multi-interface polymer analysis. A broad water cluster ion beam or a water vapour jet is undesirable for frozen samples owing to the danger of frost formation over the sample surface.

SUMMARY OF THE DISCLOSURE

In accordance with an aspect of the present disclosure, there is provided a mass spectrometer comprising: means for producing a primary beam of ions for bombarding a sample under vacuum; and a detector for detecting a secondary beam of ions released from the sample; wherein the primary beam of ions includes water clusters where each water cluster contains between 1 and 10,000 water molecules.

Amongst other advantages, such a mass spectrometer may produce higher yields of molecular secondary ions in comparison with established ion beams, thereby enhancing the chemical information obtained from the sample.

In a particularly preferable embodiment, each water cluster contains between 100 and 2000 water molecules.

The primary beam of ions may be produced by adiabatic expansion of water vapour, and, in particular, may be adiabatically expanded by passing from a high pressure region to a lower pressure region through a nozzle. The lower pressure region may have a pressure of 1 mBar or less.

The primary beam of ions may be accelerated to an energy between 1 keV and 40 keV prior to bombarding the sample.

The mass spectrometer may further comprise a mass filter for defining a cluster size distribution of the primary ion beam.

In some embodiments, the primary ion beam may additionally include one or more of helium, argon and nitrogen.

The mass spectrometer may further comprise means for producing an auxiliary beam of ions for bombarding the sample, where the auxiliary beam of ions comprises different species to those of the primary beam of ions. The primary beam of ions and the auxiliary beam of ions may be arranged to simultaneously bombard the sample. Alternatively, the primary beam of ions and the auxiliary beam of ions may be arranged to alternately bombard the sample.

In certain embodiments, the detector may be arranged to detect a secondary beam of ions released from the sample due to bombardment of the sample by the primary beam.

In alternative embodiments, the detector may be arranged to detect a secondary beam of ions released from the sample due to bombardment of the sample by the auxiliary beam.

The mass spectrometer may further comprise a sampling device arranged to create pulses of the secondary beam of ions.

The primary beam of ions may be arranged to irradiate the sample, to deliver protons to the sample, and/or etch material away from the sample.

In accordance with an aspect of the present disclosure, there is provided an analytical method whereby a primary ionised beam of water clusters and/or clusters comprising a mixture of water molecules with atoms or molecules of one or more other gases is used to bombard a sample under vacuum either: i) as a secondary ion mass spectrometry (SIMS) analysis beam, or ii) as a sputter beam during, or in rapid alternation with, bombardment by an auxiliary beam of ions that is acting as a SIMS analysis beam, or iii) as a water dosing beam during, or in rapid alternation with, bombardment by an auxiliary beam of ions that is acting as a SIMS analysis beam, in order to produce an enhanced signal of secondary ions at the detector of a SIMS analyser, thereby enhancing the chemical information obtained from the sample, wherein the primary ionised beam includes water clusters where each water cluster contains between 1 and 10,000 water molecules.

The auxiliary beam of ions may comprise different species to those of the primary ionised beam.

The auxiliary beam of ions may comprise different species to those of the primary ionised beam.

In certain embodiments, secondary ions produced by bombardment of the sample with the primary ionised beam may not be collected, but secondary ions produced by bombardment of the sample with the auxiliary beam after bombardment of the sample with the primary ionised beam may be collected and analysed.

The primary ionised beam may have a velocity component normal to a surface of the sample that is sufficiently low so as to produce substantially no secondary ions.

In certain embodiments, secondary ions produced by bombardment of the sample with the primary ionised beam may be collected and analysed, and secondary ions produced by bombardment of the sample with the auxiliary beam after bombardment of the sample with the primary ionised beam may also be collected and analysed.

In some embodiments, the primary ionised beam may be focussed and rastered on the sample, thereby allowing a spectral image of the secondary ions to be generated from an area of the sample being bombarded.

The primary ionised beam may be produced by adiabatically expanding water vapour from a from a high pressure region to a lower pressure region through a nozzle. The lower pressure region may have a pressure of 1 mBar or less. The primary beam of ions may be accelerated to an energy between 1 keV and 40 keV prior to bombarding the sample. The primary ionised beam may additionally include one or more of helium, argon and nitrogen.

An area of the sample being bombarded may be repeatedly etched by the primary ionised beam thereby eroding away a surface of the sample in layers, with secondary ion data for each layer being collected such that chemical information for different depths below the surface is acquired.

The primary ionised beam may be pulsed on and off to produce a pulsed primary ionised beam.

The secondary ions may be pulsed to produce a pulsed secondary ionised beam.

In accordance with an aspect of the present disclosure, there is provided an analytical method whereby an ionised beam of water clusters and/or clusters comprising a mixture of water vapour with one or more other gases is used to bombard a sample under vacuum either: i) as a SIMS analysis beam, or ii) as a sputter beam during, or in rapid alternation with, bombardment by another beam that is acting as a SIMS analysis beam, or iii) as a water dosing beam during, or in rapid alternation with, bombardment by another beam that is acting as a SIMS analysis beam, in order to produce an enhanced signal of secondary ions at the detector of a SIMS analyser, thereby enhancing the chemical information obtained from the sample.

In accordance with an aspect of the present disclosure, there is provided an analytical method whereby the surface of the sample to be analysed is bombarded with water cluster ions and/or clusters comprising a mixture of water vapour with one or more other gases, the secondary ions produced by this not collected, and then to benefit from the enhancement of the water a second ion beam of a different species (not water) is used to bombard part or all of the surface just bombarded by the water clusters, and the ions generated by this second ion beam are collected and analysed.

In accordance with an aspect of the present disclosure, there is provided an analytical method whereby the surface of the sample to be analysed is bombarded with water cluster ions and/or clusters comprising a mixture of water vapour with one or more other gases, the secondary ions produced collected and analysed, and then shortly afterwards to benefit from the enhancement of the water a second ion beam of a different species (not water) is used to bombard part or all of the surface just bombarded by the water clusters, and the secondary ions generated by this second ion beam are collected and analysed.

In accordance with an aspect of the present disclosure, there is provided an analytical method whereby the surface of the sample to be analysed is bombarded with water cluster ions and/or clusters comprising a mixture of water vapour with one or more other gases with sufficiently low velocity component normal to the sample surface to produce no secondary ions, and then shortly afterwards, to benefit from the enhancement of the water, a second ion beam of a different species (not water) is used to bombard part or all of the surface just bombarded by the water clusters, and the secondary ions generated by this second ion beam collected and analysed.

In accordance with an aspect of the present disclosure, there is provided an analytical method in which the beam of water clusters and/or clusters comprising a mixture of water vapour with one or more other gases can be selected to have a desired cluster size range by tuning of the gas cluster source conditions, the ioniser conditions, a mass filter, or by a combination of these.

In accordance with an aspect of the present disclosure, there is provided an analytical method in which the beam of water clusters and/or clusters comprising a mixture of water vapour with one or more other gases can be selected to have a desired cluster size range by tuning of the gas cluster source conditions, the ioniser conditions, a mass filter, or by a combination of these.

In accordance with an aspect of the present disclosure, there is provided an analytical method in which the beam of water clusters and/or clusters comprising a mixture of water vapour with one or more other gases can be selected to have a desired cluster size range (500 to 4000 molecules, but that could range from 2 to 20,000) by tuning of the gas cluster source conditions, the ioniser conditions, a mass filter, or by a combination of these.

In accordance with an aspect of the present disclosure, there is provided an analytical method in which the beam of water clusters and/or clusters comprising a mixture of water vapour with one or more other gases can be selected to have a desired cluster size range by tuning of the gas cluster source conditions, the ioniser conditions, a mass filter, or by a combination of these.

The ionised beam of water clusters and/or clusters may have a cluster size distribution typically centred within the range of 500 to 4000 molecules, but that could range from 2 to 20,000.

The beam of water clusters and/or clusters comprising a mixture of water vapour with one or more other gases can be selected to have a desired cluster size range (500 to 4000 molecules, but that could range from 2 to 20,000) by tuning of the gas cluster source conditions, the ioniser conditions, a mass filter, or by a combination of these.

The beam of water clusters and/or clusters comprising a mixture of water vapour with one or more other gases may be focussed and rastered on the sample, allowing a spectral image of the secondary ions to be generated from the sample area being bombarded.

The beam of ionised water clusters and/or clusters comprising a mixture of water vapour with one or more other gases may be produced by expansion of water vapour from a region of higher pressure through a nozzle into a region of lower pressure (which may be less than 1 mBar), then ionised and then accelerated to an energy in the range from 1 keV to 40 keV.

The gas used to produce the water clusters may not be pure water, but a mixture comprising water vapour and one or more other gases included; for example, but not exclusively, water clusters produced using combinations of water vapour and helium argon or nitrogen.

The area being bombarded may be repeatedly etched by the water cluster beam and/or clusters comprising a mixture of water vapour with one or more other gases, eroding away the surface in layers, with the secondary ion data for each layer taken such that chemical information for different depths below the surface is acquired.

The surface of the sample to be analysed may be bombarded with water cluster ions and/or clusters comprising a mixture of water vapour with one or more other gases, the secondary ions produced by this not collected, and then to benefit from the enhancement of the water a second ion beam of a different species (not water) is used to bombard part or all of the surface just bombarded by the water clusters, and the ions generated by this second ion beam are collected and analysed.

The surface of the sample to be analysed may be bombarded with water cluster ions and/or clusters comprising a mixture of water vapour with one or more other gases, the secondary ions produced collected and analysed, and then shortly afterwards to benefit from the enhancement of the water a second ion beam of a different species (not water) is used to bombard part or all of the surface just bombarded by the water clusters, and the secondary ions generated by this second ion beam are collected and analysed.

The surface of the sample to be analysed may be bombarded with water cluster ions and/or clusters comprising a mixture of water vapour with one or more other gases with sufficiently low velocity component normal to the sample surface to produce no secondary ions, and then shortly afterwards, to benefit from the enhancement of the water, a second ion beam of a different species (not water) is used to bombard part or all of the surface just bombarded by the water clusters, and the secondary ions generated by this second ion beam collected and analysed.

The beam of water clusters and/or clusters comprising a mixture of water vapour with one or more other gases may be pulsed on/off during the analysis.

In one aspect, the present disclosure is an analytical method whereby an ionised beam of water clusters is used to bombard a sample under vacuum either as a secondary ion mass spectrometry (SIMS) analysis beam, or as a water dosing beam during, or in rapid alternation with, bombardment by another beam that is acting as a SIMS analysis beam. SIMS is a technique wherein a sample is analysed by bombarding a sample, contained in a vacuum chamber, with a beam of primary ions (analysis beam), those primary ions having sufficient energy to sputter secondary ions from the sample. Such secondary ions are collected and transmitted to a mass analyser to give a mass spectrum of a small area of the sample. Cluster beams such as $C_{60}$ or giant argon clusters are currently used in SIMS analysis of organic samples, either to directly produce the secondary ions, or to sputter material from the surface revealing a new, fresh surface to be analysed by a second beam. Aspects of the present disclosure relate to a water cluster ion source and that has demonstrated higher yields of molecular secondary ions when used in a mass spectrometer in comparison with established ion beams, thereby enhancing the chemical information obtained from the sample.

BRIEF DESCRIPTION OF THE DRAWINGS

Embodiments of the disclosure are further described hereinafter with reference to the accompanying drawings, in which:

FIG. 3A shows a spectrum acquired using a primary beam of argon 1000 clusters and FIG. 3B shows a spectrum acquired using a primary beam of $H_2O_{1000}$ clusters;

FIG. 4A shows a plot acquired using a primary beam of argon 1000 clusters and FIG. 4B shows a plot acquired using a primary beam of $H_2O_{1000}$ clusters;

DETAILED DESCRIPTION OF THE DISCLOSURE

Figure 1:
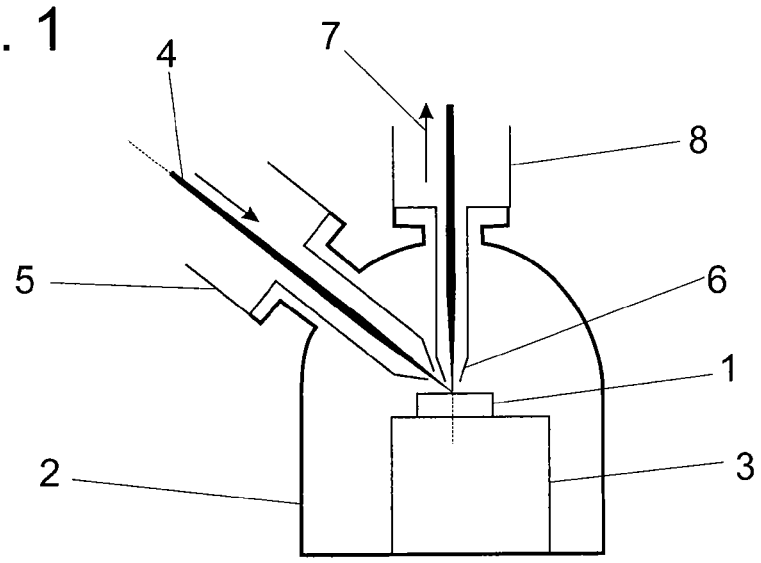
FIG. 1 shows a schematic view of part of a prior art ToF-SIMS instrument.
Figure 2:
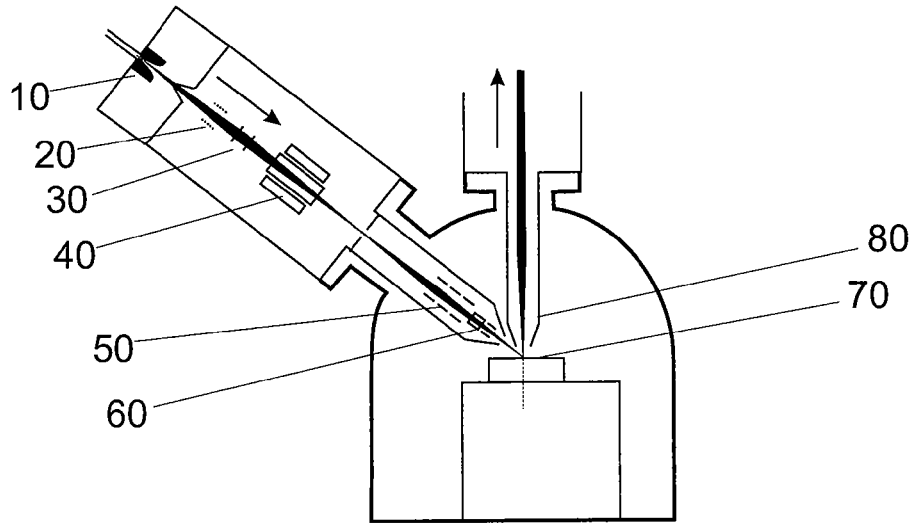
FIG. 2 shows a schematic view of a part of an apparatus in accordance with an embodiment of the present disclosure.

Aspects of the present disclosure relate to a water cluster primary ion beam which can be used to irradiate a sample. The water clusters in this beam fall into a size range between 1 and 10000 water molecules per cluster ($(H_2O)_1$ and $(H_2O)_{10000}$), with the most useful range generally between $(H_2O)_{100}$ and $(H_2O)_{2000}$. It should be noted that this size range is well below the water droplet size range normally produced by an electrospray source. This is important in the SIMS application as larger clusters or droplets cause undue wetting of the sample surface or frosting in the case of cold samples. Samples are frequently cooled to near liquid nitrogen temperature in organic analysis. We have demonstrated advantages for use of this ion beam with organic samples, including samples of lipids, amino acids and peptides. We expect the increased ion yields to be also observed with cell and tissue samples, including frozen ones, polymers and inorganic samples. The water clusters, generated by adiabatic gas expansion and subsequent ionisation by electron bombardment, were selected within a range between $(H_2O)_1$ and $(H_2O)_{10000}$. FIG. 2 shows the setup of the apparatus used. Water clusters were generated by water vapour expansion through a nozzle (10) and then the water vapour was ionised in an electron bombardment source (20). The ionised clusters were accelerated to 10 keV in transit through the extraction optics (30) before passing through a mass filter (40) which defines the cluster size distribution to be used. An electrostatic lens (50) focused the beam and electrostatic deflection plates (60) rastered the beam over the sample surface. In principle, the beam can be focused to a spot size of less than 5 microns with this optical system. The focused cluster beam impacted on the sample (70). Secondary ions from the sample were collected into the secondary ion extraction optics (80) and transmitted to the mass analyser.

In a Time of Flight system it is necessary to create pulses of secondary ions in order that the time between the creation of the pulse and its arrival at the detector can be measured for each ion mass that occurs in the secondary ion beam. To achieve high mass resolution, the pulses need to be very short, typically not much in excess of 1 ns. Our apparatus used a secondary beam sampling device (known as a shaped field buncher) to create short secondary beam pulses. With this method of pulse generation, it is not necessary to use fast pulses in the primary ion beam. Thus, we were able to use the water cluster beam to perform analysis, in addition to delivering protons to the sample and etching the sample, the single beam performing the three functions simultaneously. In more conventional ToF-SIMS instruments, the short secondary ion pulses are formed by fast-pulsing the primary ion beam, so that ions only leave the sample in short pulses. Since beams of cluster ions cannot be pulsed quickly, they give very poor mass resolution if used as analysis beams in such instruments. Therefore, another mode of use would be employed in which the water cluster beam alternates with a second beam, long pulses of the water cluster beam providing proton dosing and low-damage etching, while a fast-pulsing second beam provides SIMS analysis. In this mode, any material removed from the sample during the water cluster beam etching is lost and not available for analysis. For this reason, an apparatus such as ours, with secondary beam sampling provides a better platform for application of the water cluster beam.

Figure 3A:
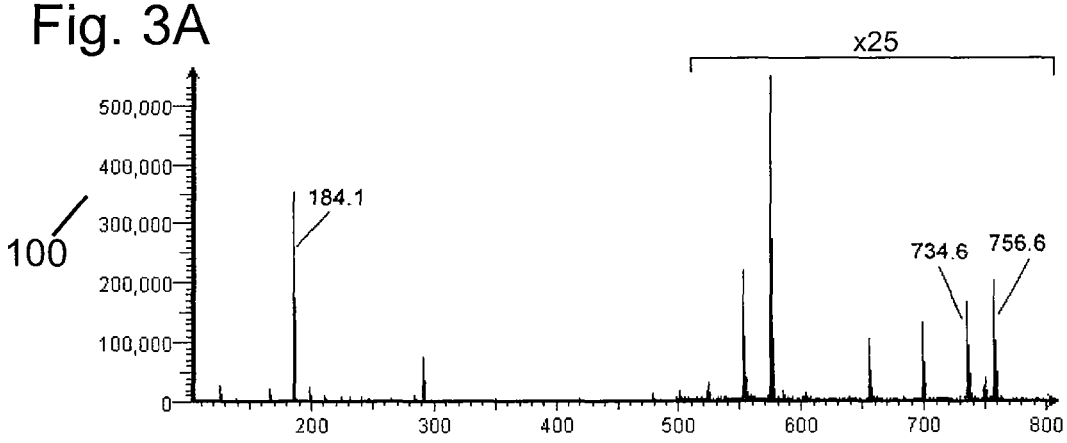
FIGS. 3A and 3B show SIMS spectra acquired from a sample of DPPC where
Figure 3B:
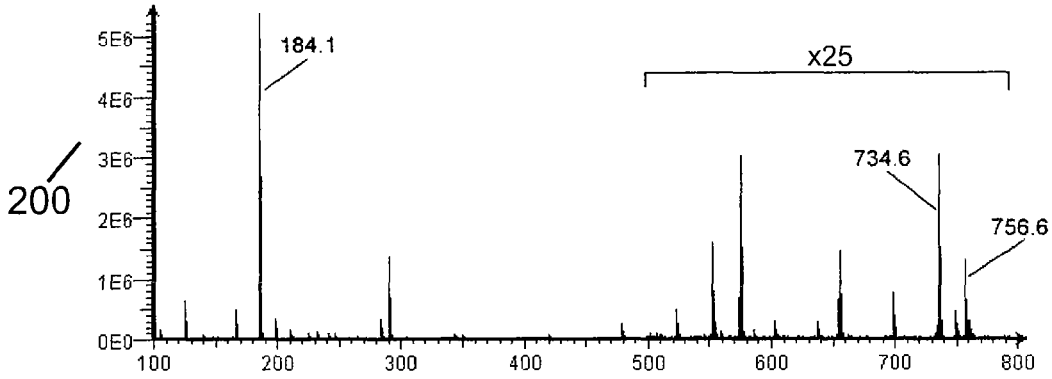

We have shown that the resulting ion yields, and hence the sensitivity of our SIMS instrumentation, is substantially higher with the water cluster beam compared with the yields from argon cluster beam bombardment. FIG. 3 shows SIMS spectra acquired from a sample of DPPC, a common lipid, FIG. 3A taken using a primary beam of argon 1000 clusters and FIG. 3B taken with a primary beam of $H_2O_{1000}$ clusters. The argon cluster beam was set up for a mass distribution around $Ar_{1000}^+$ cluster ions, whilst the water cluster beam was comprised of a distribution around $(H_20)_{1000}^+$. Both beams were operated at 10 keV with an incident angle of 45 degrees. The ion dose in each case was 1e11 ions $cm^2$. In each of these plots, the phosphocholine headgroup, the M+H ion and the M+Na ion are labelled as 184.1, 734.6 and 756.6 respectively, the numbers signifying mass/charge in Daltons. The intensity scale (100,200) in each plot is normalised to equal primary ion dose. Comparison of FIGS. 3A and 3B shows that peak intensities are higher with the water cluster beam by a factor of approximately 16 for the 184.1 peak and a factor of 18 for the M+H ion. The enhancement in the $M+H^+$ signals provides evidence of yield enhancement through direct protonation of molecules by $H^+$ ions released from the incident clusters during the sputtering process. The increase in the $M+Na^+$, and indeed across the whole mass spectrum shows that charge exchange processes occurring between free $H^+$ ions and organic molecules enhance the yield of most, if not all, secondary ion species. This indicates that the water beam is useful both as a primary analysis beam and as a dosing beam used in conjunction with another beam as the primary analysis beam. This is important, indicating a further mode of use where the water beam is used merely for dosing the sample while the analysis of the sample is undertaken by a second ion beam of a different species, such as liquid metal clusters.

Figure 4A:
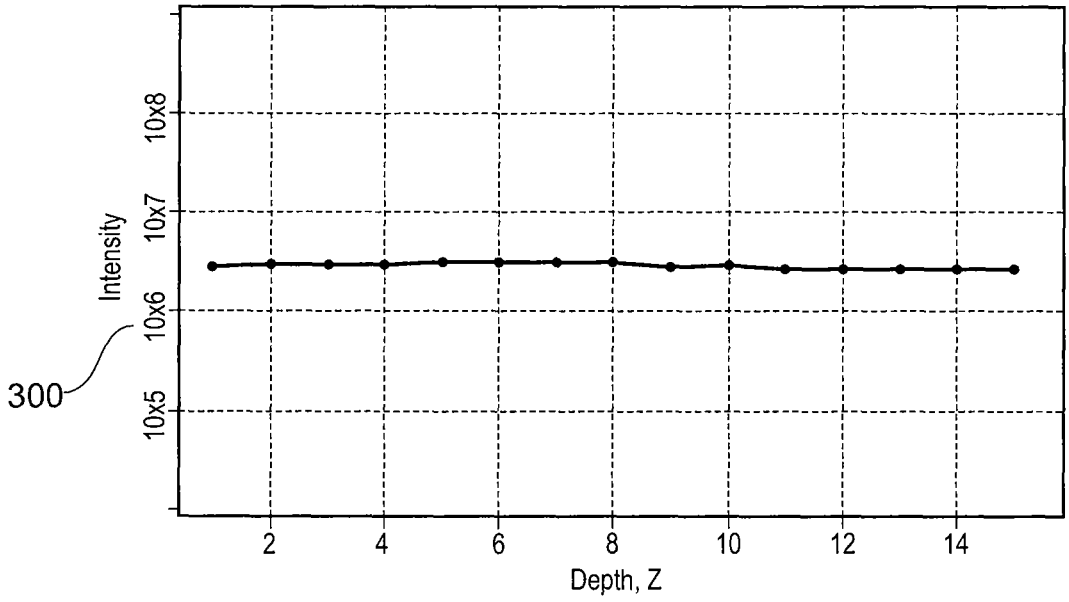
FIGS. 4A and 4B show intensity plots in relation to sample depth where
Figure 4B:
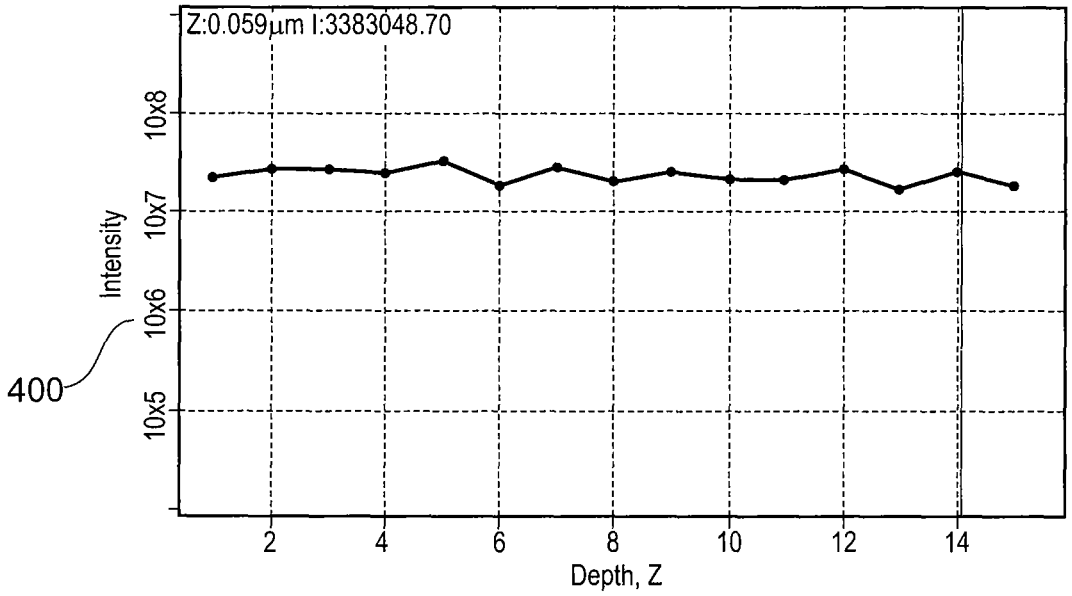

The water cluster ion beam was also used for a prolonged analysis in which several layers were etched from the sample without significant deterioration in spectra. The result of this is shown in FIGS. 4A and 4B, showing results for the argon 1000 primary beam and for the $H_2O_{1000}$ primary beam respectively, used on a sample of arginine, an α amino acid. The normalised intensity scales (300,400) show the signal for the $M+H^+$ remaining stable in both cases as the sample is etched away, taking intensity readings from 15 layers. Comparison of intensities in the two plots shows 8 to 10 times higher signal with the water beam. This demonstrated that the water cluster ion beam is suitable as a low-damaging sputter beam. It was also noted that satisfactory vacuum conditions were sustained during analyses and there was no unintended modification of the sample chemistry. This indicates a further mode of use where the water cluster beam is used to etch layers from the sample, at the same time providing protonation of the sample, alternating with an analysis beam, such as a liquid metal ion beam.

Figure 5A:
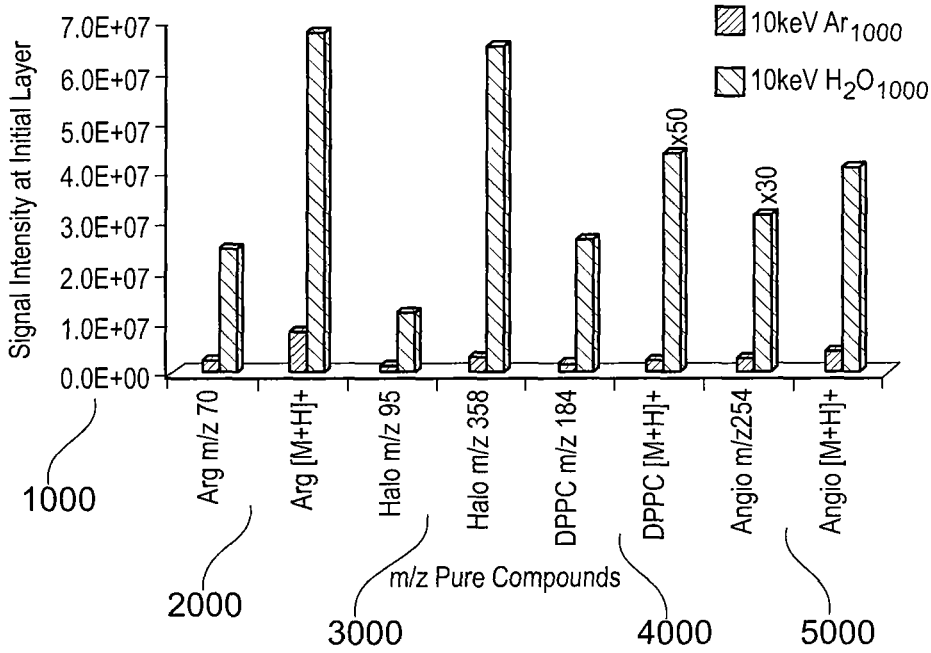
FIG. 5A shows a plot of signal intensity at the initial layer for several sample materials for a 10 keV primary beam of $Ar_{1000}$ and $H_2O_{1000}$ clusters.
Figure 5B:
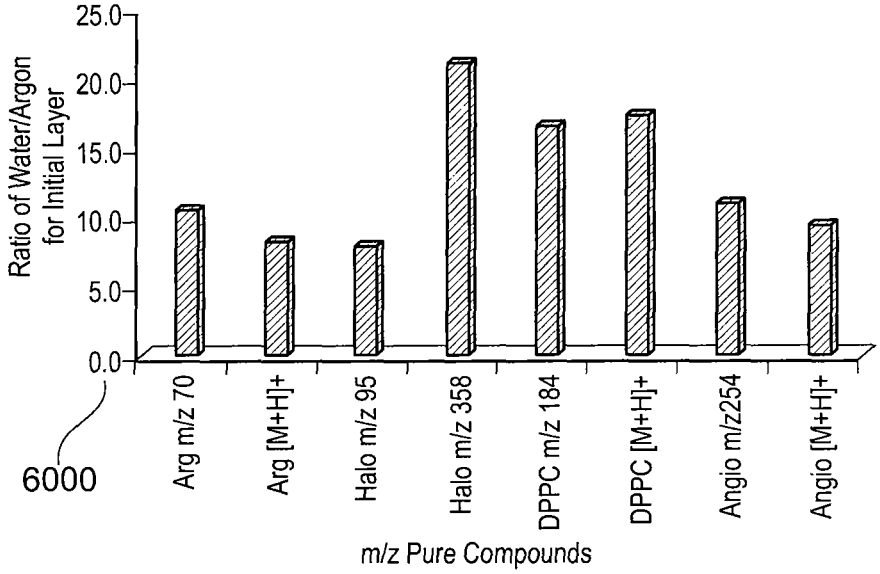
FIG. 5B shows a plot of the ratio of water/argon signal intensities for each of the sample materials of FIG. 5A.

FIG. 5 shows the results of tests on a wider range of compounds, selecting two significant mass peaks for each compound giving a total of 8 results comparing secondary ion intensity (1000) with an argon cluster beam and the water cluster beam. The argon cluster beam was set up for a mass distribution around $Ar_{1000}^+$ cluster ions, whilst the water cluster beam was comprised of a distribution around $(H_2O)_{1000}^+$. Both beams were operated at 10 keV with an incident angle of 45 degrees. The ion dose in each case was 1e11 ions $cm^{-2}$. The figure shows the comparison for the intensity achieved with the water cluster beam, shown as a grey column, versus that with the argon cluster beam, shown as a black column for the eight different species. The compounds are arginine (2000), haloperidol (3000), dipalmitoylphosphatidylcholine (4000) and angiotensin (5000). The plot on the right hand side of the figure shows the ratios of intensities achieved with the two beams (6000), ranging from 8 times to over 20 times in favour of the water clusters.

A significant drawback of the ToF-SIMS technique with existing ion beams is an inability to quantify concentrations of different substances in the sample, owing to large variations in ion yield between substances. A major cause of this is differences in affinity to protonation in organic molecules. By saturating the analysis location with protons and overcoming the variations in protonation, our disclosure will facilitate more quantitative analysis.

The invention claimed is:

1. A mass spectrometer, comprising:

means for producing a primary beam of ions for bombarding a sample under vacuum; and a detector for detecting a secondary beam of ions released from the sample;

wherein the primary beam of ions includes water clusters where each water cluster contains between 1 and 10,000 water molecules.

2. The mass spectrometer of claim 1, wherein each water cluster contains between 100 and 2000 water molecules.

3. The mass spectrometer of claim 1, wherein the primary beam of ions is produced by adiabatic expansion of water vapour.

4. The mass spectrometer of claim 3, wherein the water vapour is adiabatically expanded by passing from a high pressure region to a lower pressure region through a nozzle.

5. The mass spectrometer of claim 4, wherein the lower pressure region has a pressure of 1 mBar or less.

6. The mass spectrometer of claim 1, wherein the primary beam of ions is accelerated to an energy between 1 keV and 40 keV prior to bombarding the sample.

7. The mass spectrometer of claim 1, further comprising a mass filter for defining a cluster size distribution of the primary ion beam.

8. The mass spectrometer of claim 1, wherein the primary ion beam additionally includes one or more of helium, argon and nitrogen.

9. The mass spectrometer of claim 1, further comprising means for producing an auxiliary beam of ions for bombarding the sample, where the auxiliary beam of ions comprises different species to those of the primary beam of ions.

10. The mass spectrometer of claim 9, wherein the primary beam of ions and the auxiliary beam of ions are arranged to simultaneously bombard the sample.

11. The mass spectrometer of claim 9, wherein the primary beam of ions and the auxiliary beam of ions are arranged to alternately bombard the sample.

12. The mass spectrometer of claim 9, wherein the detector is arranged to detect a secondary beam of ions released from the sample due to bombardment of the sample by the primary beam.

13. The mass spectrometer of claim 9, wherein the detector is arranged to detect a secondary beam of ions released from the sample due to bombardment of the sample by the auxiliary beam.

14. The mass spectrometer of claim 1, further comprising a sampling device arranged to create pulses of the secondary beam of ions.

15. The mass spectrometer of claim 1, wherein the primary beam of ions is arranged to irradiate the sample.

16. The mass spectrometer of claim 1, wherein the primary beam of ions is arranged to deliver protons to the sample.

17. The mass spectrometer of claim 1, wherein the primary beam of ions is arranged to etch material away from the sample.

18. An analytical method, comprising:

bombarding a sample under vacuum using a primary ionized beam of water clusters or clusters of a mixture of water molecules with atoms or molecules of one or more other gases; and producing an enhanced signal of secondary ions from the sample at a detector of a secondary ion mass spectrometry (SIMS) analyser, thereby enhancing the chemical information obtained from the sample;

wherein the primary ionized beam is used as i) a SIMS analysis beam, ii) a sputter beam during, or in rapid alternation with, bombardment by an auxiliary beam of ions that is acting as a SIMS analysis beam, or iii) a water dosing beam during, or in rapid alternation with, bombardment by an auxiliary beam of ions that is acting as a SIMS analysis beam; and further wherein, the primary ionized beam includes water clusters where each water cluster contains between 1 and 10,000 water molecules.

19. The analytical method of claim 18, wherein the auxiliary beam of ions comprises different species to those of the primary ionized beam.

20. The analytical method of claim 19, wherein secondary ions produced by bombardment of the sample with the primary ionized beam are not collected, but secondary ions produced by bombardment of the sample with the auxiliary beam after bombardment of the sample with the primary ionised beam are collected and analyzed.

21. The analytical method claim 20, wherein the primary ionized beam has a velocity component normal to a surface of the sample that is sufficiently low so as to produce substantially no secondary ions.

22. The analytical method of claim 19, wherein secondary ions produced by bombardment of the sample with the primary ionised beam are collected and analysed, and secondary ions produced by bombardment of the sample with the auxiliary beam after bombardment of the sample with the primary ionised beam are also collected and analysed.

23. The analytical method of claim 18, wherein the primary ionized beam is focused and rastered on the sample, thereby allowing a spectral image of the secondary ions to be generated from an area of the sample being bombarded.

24. The analytical method of claim 18, wherein the primary ionized beam is produced by adiabatically expanding water vapour from a high pressure region to a lower pressure region through a nozzle.

25. The analytical method of claim 24, wherein the lower pressure region has a pressure of 1 mBar or less.

26. The analytical method of claim 18, wherein the primary beam of ions is accelerated to an energy between 1 keV and 40 keV prior to bombarding the sample.

27. The analytical method of claim 18, wherein the primary ionized beam additionally includes one or more of helium, argon and nitrogen.

28. The analytical method of claim 18, wherein an area of the sample being bombarded is repeatedly etched by the primary ionized beam thereby eroding away a surface of the sample in layers, with secondary ion data for each layer being collected such that chemical information for different depths below the surface is acquired.

29. The analytical method of claim 18, further comprising:

pulsing the primary ionized beam on and off; and producing a pulsed primary ionized beam.

30. The analytical method of claim 18, wherein the secondary ions are pulsed to produce a pulsed secondary ionised beam.

* * * * *